US007502032B2

(12) United States Patent
Richardson et al.

(10) Patent No.: US 7,502,032 B2
(45) Date of Patent: Mar. 10, 2009

(54) INTEGRATING COLOR DISCRIMINATION ASSESSMENT INTO OPERATING SYSTEM COLOR SELECTION

(75) Inventors: Cyra S Richardson, Bellevue, WA (US); Peter A Gurevich, Woodenville, WA (US); Thomas W Olsen, Issaquah, WA (US); Bradley Phillip Gibson, Seattle, WA (US); Michael D Stokes, Eagle, ID (US)

(73) Assignee: Microsoft Corporation, Redmond, WA (US)

( * ) Notice: Subject to any disclaimer, the term of this patent is extended or adjusted under 35 U.S.C. 154(b) by 513 days.

(21) Appl. No.: 10/959,813

(22) Filed: Oct. 6, 2004

(65) Prior Publication Data

US 2006/0071938 A1 Apr. 6, 2006

(51) Int. Cl.
*G09G 5/02* (2006.01)

(52) U.S. Cl. ..... 345/591

(58) Field of Classification Search ..... 345/590, 345/591, 593; 382/167
See application file for complete search history.

(56) References Cited

U.S. PATENT DOCUMENTS 5,589,898 A * 12/1996 Atkinson ..... 351/237

* cited by examiner

*Primary Examiner*—Matthew C. Bella
*Assistant Examiner*—G. F. Cunningham
(74) *Attorney, Agent, or Firm*—Lee & Hayes, PLLC

(57) ABSTRACT

An operating system (OS) includes a color adjuster that can map a color space to an adjusted color space that a user can discriminate. The color adjuster can map colors in the gaps of the user's discriminable color space to colors that the user can discriminate or, alternatively to cues. The OS can also include an assessor to determine whether a user would benefit from the use of an adjusted color space. The assessor can also receive color discrimination data associated with a user without having to perform an assessment (e.g., from a profile or "passport" that includes data from a previous assessment performed on another computer or device). This data can be stored on removable media, a smart device, a node on a network, and then accessed by the assessor.

39 Claims, 7 Drawing Sheets

INTEGRATING COLOR DISCRIMINATION ASSESSMENT INTO OPERATING SYSTEM COLOR SELECTION

FIELD

Various embodiments described below relate generally to computers and like devices, and more particularly but not exclusively to operating systems used in computers and like devices. Still more particularly, various embodiments relate to color management in operating systems used in displaying images.

BACKGROUND

Currently-available operation systems can include a color setting feature that allows a user to select how colors are to be displayed. For example, for a computer system having a monitor, the computer system's operating system may allow the user to change colors settings (e.g., the number of colors to be displayable using the monitor). Such operating systems may allow a user to select one of several "themes" that include color settings, font selection, background images, icons, cursor shapes, etc. However, conventional operating system color settings are geared for users having normal color discrimination abilities and do not have any mechanism for changing color settings in a way to improve the visual experience for users having color discrimination problems or disabilities. These problems are most commonly genetic and can be expressed as defective cones in the retina. Other causes are aging of the eye, damage to cones (e.g., from exposure to ultraviolet light), etc. The One type of color discrimination disability is dyschromatopsia (commonly referred to as colorblindness). A colorblind person typically cannot discriminate between two colors; e.g., red and green. One common cause of red-green color blindness is missing green-sensitive pigment (e.g., due to missing or damage medium wavelength cones), which is a condition called deuteranopia. Another cause is abnormal green sensitivity (due to a defect in the green sensitive pigment in the medium wavelength cones), which is a condition called deuteranomaly. To such colorblind people, a red object and a green object may be perceived as having the same color. Further, if an image being displayed has a green region adjacent to a red region, then such color blind people would likely perceive the two adjacent regions as one large region. Consequently, colorblind users may encounter difficulties or a diminished experience in using a computer or like device. As previously mentioned, it is believed that conventional operating systems do not have any mechanism for changing color settings in a way to improve the visual experience for users having color discrimination problems or disabilities.

SUMMARY

The paragraphs that follow represent a summary to provide a basic understanding to the reader. The summary is not an exhaustive or limiting overview of the disclosure. Further, the summary is not provided to identify key and/or critical elements of the invention, delineate the scope of the invention, or limit the scope of the invention in any way. The purpose of the summary is to introduce one or more of the concepts described below in a simplified form.

According to aspects of the various embodiments, methods and apparatus are provided for use in an operating system to improve the visual experience of a user that has a color discrimination disability. In one aspect, the operating system includes a color adjuster that can map a user's discriminable color space to an adjusted color space having colors in the user's discriminable color space (i.e., colors that the user can discriminate). As used herein in this context, the user's discriminable color space corresponds to colors in the visible spectrum that the user can discriminate. There may be gaps in the user's discriminable color space resulting from defects such deuteranopia or deuteranomaly. In this aspect, the color adjuster maps colors (that can be discriminated by users having normal color discrimination) in the gaps of the user's discriminable color space colors that the user can discriminate.

In another aspect, the color adjuster is configured to map colors in the gaps of the user's discriminable color space to cues. For example, the color adjuster may cause a color in a gap of the user's discriminable color space to flash when displayed, while another color in the color gap would be cross-hatched when displayed. These different cues allow the user to discriminate between colors that fall within gaps in the user's discriminable color space.

In another aspect, the operation system includes a color discrimination assessor to determine whether a user would benefit from the use of an adjusted color space. The color discrimination assessor can provide an automated color discrimination test that the user can take during an initialization or set-up process. From the results of the test, the user's discriminable color space can be determined or estimated. In a further refinement of this aspect, the assessment may be adaptive. For example, in scenarios in which the user does not wish to have complete test performed, the color discrimination assessor may first perform a short simple test for the most common type of colorblindness and associate the user with a predefined color space for that type of colorblindness. If the user does not have the most common type of colorblindness, the color discrimination assessor may then perform a short simple test for the next most common type of colorblindness, and so on. The user may then at a later time use the color discrimination assessor to more accurately determine the user's discriminable color space.

In a related aspect, the color adjuster may have predetermined mappings for these common types of colorblindness. These predetermined mappings may not ideally compensate for the user's particular color space but can provide adequate visual experience for the user.

In still another aspect, the color discrimination assessor can receive color discrimination data associated with a user without having to perform an assessment. For example, the user may have a profile or "passport" that includes data from a previous assessment performed on another computer or device. This previously-obtained assessment data can be stored on removable media, a smart device, a node on a network, and then accessed by the color discrimination assessor.

BRIEF DESCRIPTION OF THE DRAWINGS

Non-limiting and non-exhaustive embodiments are described with reference to the following figures, wherein like reference numerals refer to like parts throughout the various views unless otherwise specified.

DETAILED DESCRIPTION

The following techniques and mechanisms are directed to implementing methods and components of an operating system to improve the visual experience of users that have a color discrimination disability. In general, the operating system includes one or more components that allow the operating system to map a user's discriminable color space to an adjusted color space that omits or modifies colors that the user cannot discriminate. Stated another way, the operating system includes one or more components that maps colors (that can be discriminated by users having normal color discrimination) in the gaps of the user's discriminable color space to cues or colors that the user can discriminate. In some embodiments, the operating system may also include a component to perform color discrimination testing of the user. The results of the testing can then be used to determine the user's discriminable color space, which can then be mapped to cues and/or colors that the user can discriminate as described above. Specific implementations of this general concept are described below.

General Overview of System

Figure 1:
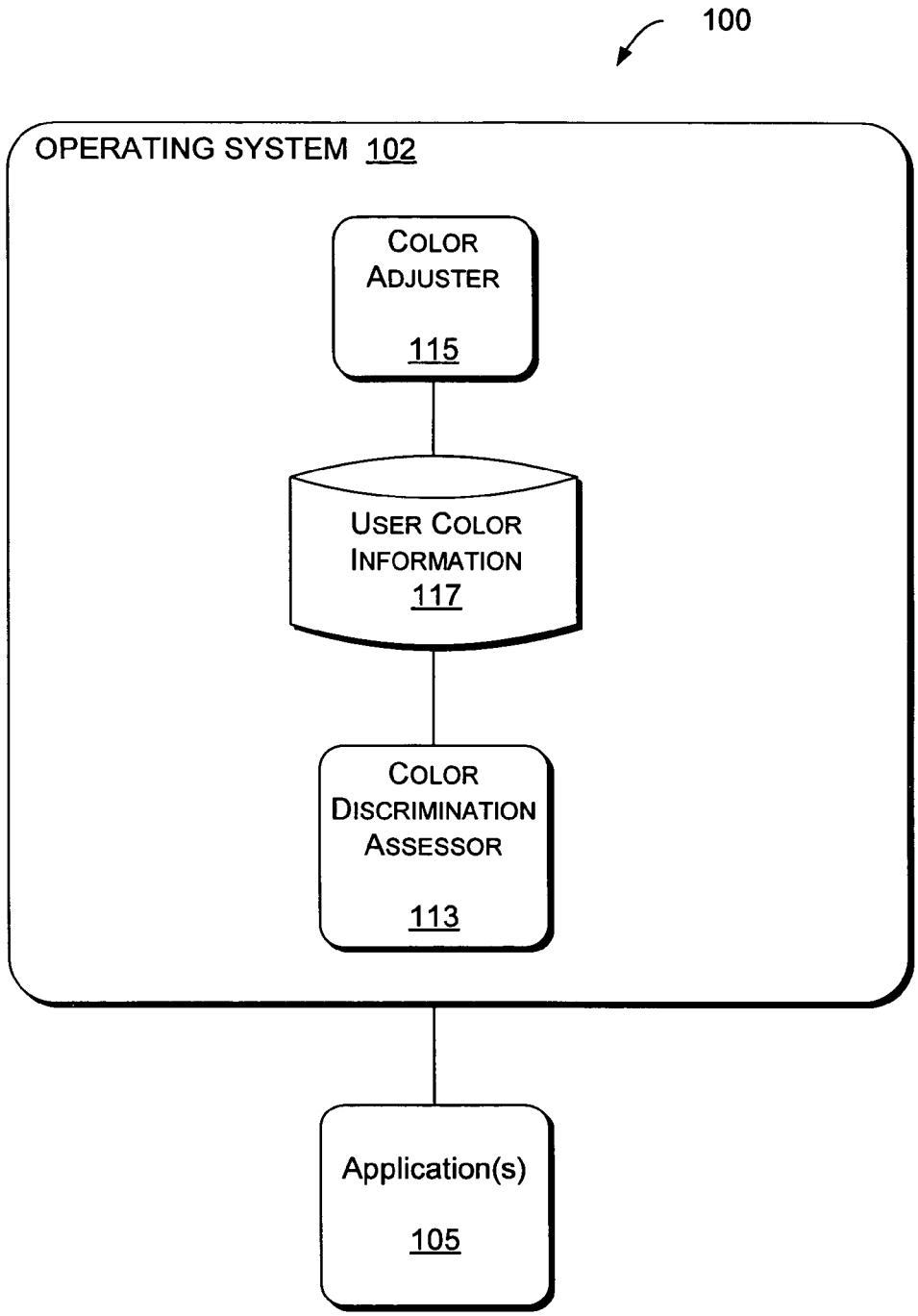
FIG. 1 is a functional block diagram illustrating a system having an operating system with a color adjuster to improve the visual experience of a user that has a color discrimination disability, according to one embodiment.

FIG. 1 illustrates a system 101 having an operating system with components to improve the visual experience of a user that has a color discrimination disability, according to one embodiment. In this embodiment, system 101 includes an operating system 103 and one or more applications 105 that as part of their operation cause a monitor or other display device (see e.g., FIG. 7) to display images (e.g., color images). Operating system 103 includes: a color discrimination assessor 113; a color adjustor 115; and a user color datastore 117 that can be used to store information regarding a user's color discrimination ability. In some embodiments, component 113, component 115 and component 117 can be part of an application program interface (API) that is exposed by operating system 103. An application 105 can call the API, passing a requested color. Then based on the user's discriminable color space, the API would then provide an adjusted color or cue to be displayed to the user. Embodiments of components 113, 115 and 117 are described in more detail below.

Color Discrimination Assessor

Figure 2:
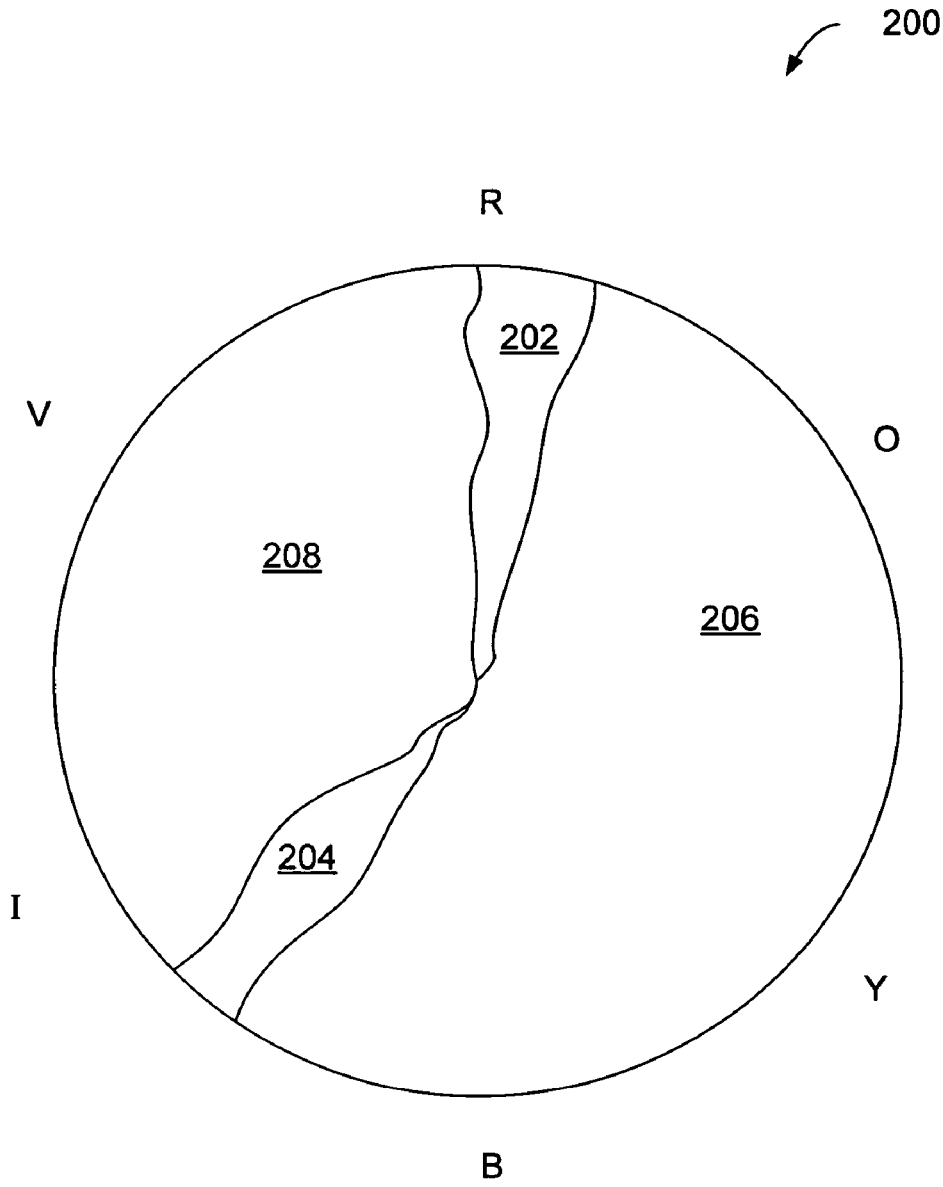
FIG. 2 is a color wheel diagram illustrating gaps in an exemplary user's discriminable color space.

Color discrimination assessor 113 can obtain information about a user's discriminable color space. In some embodiments, color discrimination assessor 113 can interact with a user to determine whether the user has a color discrimination disability. For example, color discrimination assessor 113 can perform an automated color discrimination test such as the Farnsworth-Munsell 100-Hue test. In other embodiments, other color discrimination tests may be used. FIG. 2 illustrates an exemplary color space 200 as determined by color discrimination assessor 113. In this example, the user's discriminable color space 200 is described using a color wheel in which various colors are arranged angularly and the saturation of a color depends on the radius. In this example, the user has a color discrimination disability, resulting in a color space 200 that is limited by gaps 202 and 204 (i.e., gaps are regions of a color space that a person with normal color discrimination ability would be able to discriminate). The user's discriminable color space 200 is made up of discriminable portions 206 and 208 in this example. Thus, when the user receives light having a color in either of portions 206 or 208, the user can discriminate the color; however, if the user receives light having a color in either of portions 202 or 204, the user cannot discriminate the color.

In a further refinement of this embodiment, the assessment may be adaptive. For example, in scenarios in which the user does not wish to have complete test performed, color discrimination assessor 113 may first provide a short simple test for the most common type of colorblindness and interact with the user to complete the test. This test can be relatively inaccurate. If the user does have that type of colorblindness, color discrimination assessor 113 can then associate the user with a predefined color space for that type of colorblindness. This predefined color space may not ideally correspond to the user's actual discriminable color space, but should be accurate enough to provide an adequate visual experience for the user.

If the user does not have the most common type of colorblindness, color discrimination assessor 113 may then test the user with a short simple test for the next most common type of colorblindness, and so on. The user may then at another time use color discrimination assessor 113 to more accurately determine the user's discriminable color space. In conjunction with this refinement, some embodiments of color adjuster 115 may have predetermined mappings for these common types of colorblindness. These predetermined mappings may not ideally compensate for the user's particular color space but can provide adequate visual experience for the user.

In still other embodiments, color discrimination assessor 113 may receive color discrimination data associated with a user without having to perform an assessment. For example, the user may have a profile or "passport" that includes data from a previous assessment performed on another computer or device. This previously-obtained assessment data can be stored on removable media, a smart device, a node on a network, etc., and then accessed by color discrimination assessor 113.

Color Adjuster

As previously mentioned, some embodiments of color adjuster 115 provide or generate a mapping between a requested color (e.g., requested by an application 105) and a color in an adjusted color space. In some embodiments, color adjuster 115 determines whether a requested color is within a gap of the user's discriminable color space and if so, provides an adjusted color instead of the requested color. The adjusted color may be the nearest discriminable color in the user's discriminable color space in some embodiments. For example, the user's discriminable color space may be defined in a red-blue-green (RGB) color space or a hue-saturation-value (HSV) color space. If the requested color is in a gap of the user's discriminable color space, the nearest color in the user's discriminable color space to the requested color can be determined using suitable minimum distance algorithms.

In operation, color adjuster 115, in some embodiments, maps colors that fall into gaps 202 and 204 to colors in discriminable portions 206 and 208. As previously mentioned, the mapping may be based on a nearest color algorithm. In other embodiments, color adjuster 115 uses one or more gamut mapping techniques to map the users' discriminable color space into an adjusted color. An exemplary gamut mapping technique is described below in conjunction with FIGS. 6 and 6A. In still other embodiments, color adjuster 115 maps colors that fall into gaps 202 and 204 to cues other than or in addition to the adjusted colors described above. For example, the cue can be: flashing of the displayed color; cross-hatching of the displayed color, outlining of the region having a non-discriminable color; adding text or other symbols (e.g., naming the color) in the region having the non-discriminable color. In some embodiments, the adjusted color or cue applies to all images to be displayed by system 101, including compressed or uncompressed graphics, 2-D graphics, photographs, video, streaming video, text, etc., and not just backgrounds, icons, cursors, etc. which may be part of a theme.

User Color Datastore

In some embodiments, user color datastore 117 is considered part of operating system 103; however, in other embodiments the datastore is external to the operating system. In either type of embodiment, user color datastore 117 is used to store information regarding a user's color discrimination ability. For example, user color datastore 117 can be used to store data generated by color discrimination assessor 113 (e.g., data defining the user's discriminable color space in a selected color space coordinate system), mappings between colors in the gaps (if any) of the user's discriminable color space to adjusted colors, or both. For example, the mappings can be in the form of a look-up table indexed by the colors in the gap(s). In other embodiments, the mappings can be stored as a gamut: a mathematical function designed to represent the 3-D space in the overall color gamut.

Exemplary Processes to Compensate for a Color Discrimination Disability

Figure 3:
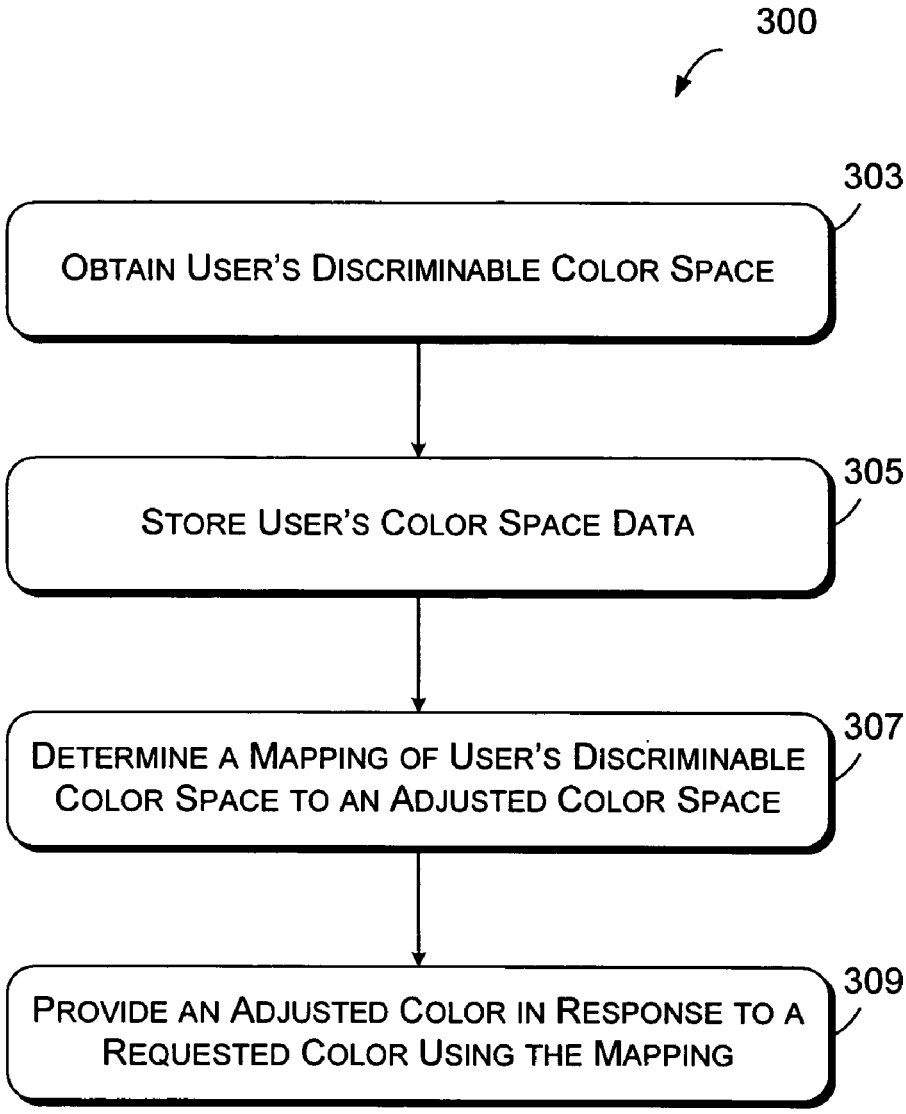
FIG. 3 is a flow diagram generally illustrating operational flow of an operating system in improving the visual experience of a user that has a color discrimination disability, according to one embodiment.

FIG. 3 illustrates a process 300 of an operating system in improving the visual experience of a user that has a color discrimination disability, according to one embodiment. Process 300 may be executed by system 101 (FIG. 1), and therefore the description of FIG. 3 may refer to at least one of the system components of FIG. 1. However, any such reference to a component of FIG. 1 is for descriptive purposes only, and it is to be understood that system 101 of FIG. 1 is a non-limiting processing environment for process 300.

At a block 303, the user's discriminable color space is determined. In some embodiments, the operating system includes a component or module (e.g., color discrimination assessor 113 shown in FIG. 1) that determines the user's discriminable color space. Such components can interact with the user to perform color discrimination tests such as the aforementioned Farnsworth-Munsell 100-Hue test or other suitable color discrimination test. One embodiment of the operation of block 303 is described in more detail below in conjunction with FIG. 4. In some embodiments, such components operate during a set-up or initialization phase when creating a user or user account in a computer system.

In some embodiments, such components may determine the user's discriminable color space without having to perform an assessment. For example, as previously mentioned, such components may receive a profile or passport associated with the user that includes data from a previous assessment performed on another computer or device. This previously-obtained assessment data can be stored on removable media, a smart device, a node on a network, and then accessed by the color discrimination assessor. Alternatively or in conjunction with other operation, such components can request that the user enter the name of the condition (e.g., deuteranopia) if the user has been previously diagnosed.

At a block 305, data related to the user's discriminable color space is stored. In some embodiments, the operating system stores data that defines the user's discriminable color space in a suitable data structure. In some embodiments, the datastore may include only gap(s) in the user's discriminable color space. For example, colors in a color space may be represented by digital values (e.g., thirty-two bit values). In N-bit embodiments, the "contiguous" nature of gaps resulting from some color discrimination disabilities allows some gaps to be defined as a range (or ranges) of N-bit values. In other embodiments, different data structures may be used to store data defining a user's discriminable color space.

At a block 307, a mapping of the user's discriminable color space to an adjusted color space is determined. In some embodiments, the operating system may include one or more components or modules that determine the mapping. For example, the mapping may be a mapping of gap(s) in the user's discriminable color space (determined at block 303 and stored in a data structure at block 305) to adjusted colors. In some embodiments, adjusted colors can include colors that the user can discriminate and/or cues. As previously described, cues can include flashing of the displayed color; cross-hatching of the displayed color, outlining of the region having a non-discriminable color; adding text or other symbols (identifying the color) inside (or outside) the region having the non-discriminable color, combinations of the above cues, etc. The mappings may be in the form of a look-up table, determined dynamically using a formula as a color is requested, etc. In some embodiments, the mappings are determined using gamut mapping techniques. An exemplary gamut mapping technique is described below in conjunction with FIGS. 6 and 6A. Further, in some embodiments, the mapping(s) may be stored in the data structure used at block 305.

At a block 309, in response to a request for a color in a gap of the user's discriminable color space, an adjusted color is provided using the mapping. For example, an application 105 (FIG. 1) can send a request to the operating system for a color to be displayed. In response, for example, color adjuster 115 (FIG. 1) can output an adjusted color using the mapping of block 305. This adjusted color can then be displayed to the user instead of the exact requested color. In some embodiments, the operational flow can then return to repeat block 309 to provide an adjusted color for the next requested color (or back to block 307 in embodiments that dynamically determine the mappings). One embodiment of the operation of block 309 is described in more detail below in conjunction with FIG. 5.

Although process 300 is illustrated and described sequentially, in other embodiments, the operations described in the blocks may be performed in different orders, multiple times, and/or in parallel.

Figure 4:
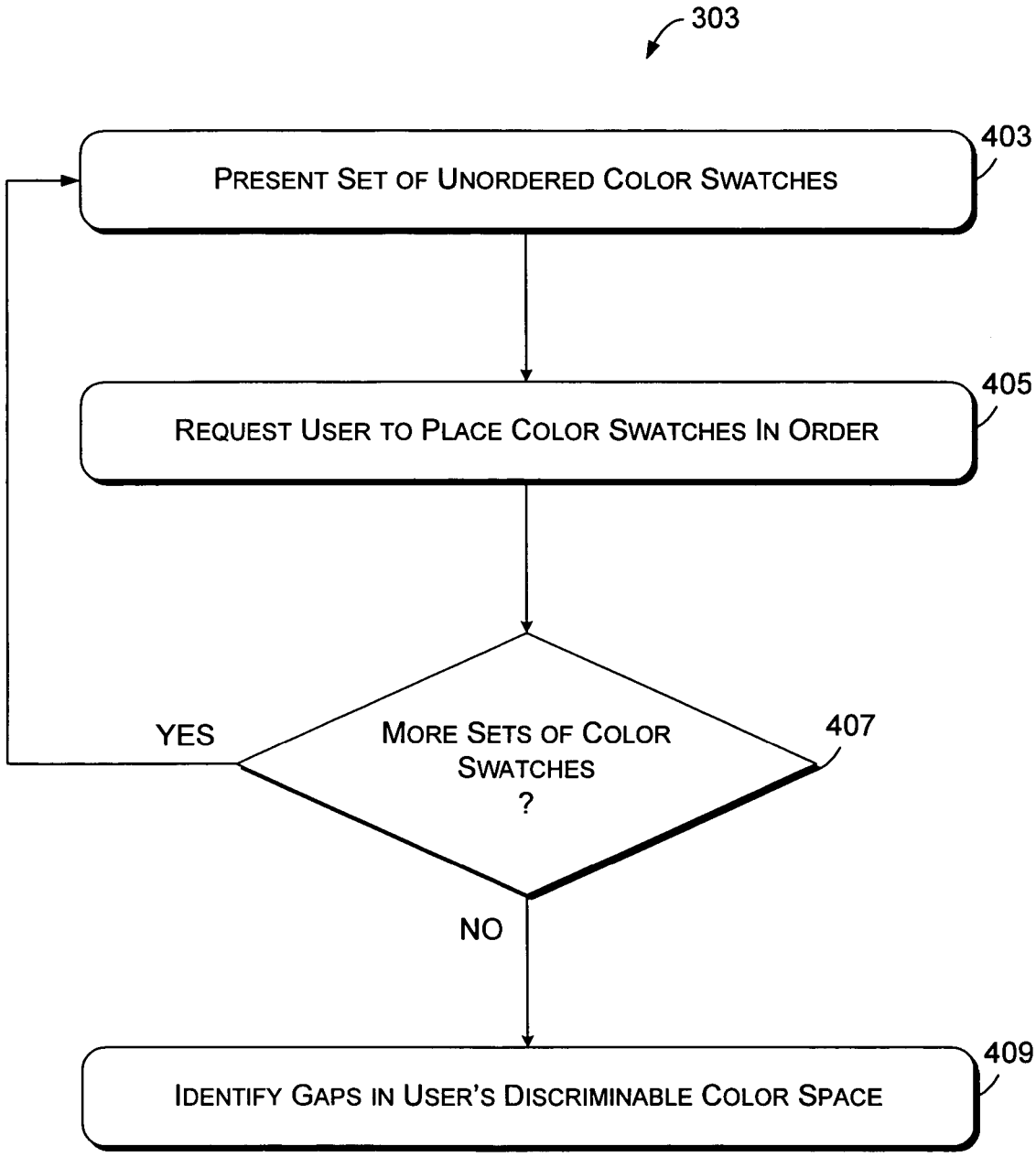
FIG. 4 is a flow diagram generally illustrating operational flow of the operating system of FIG. 3 in determining a user's discriminable color space, according to one embodiment.

FIG. 4 generally illustrates operational flow of an operating system in performing block 303 (FIG. 3), according to one embodiment. In this embodiment, block 303 includes using a color discrimination assessment test to determine a user's discriminable color space. For example, the color discrimination assessment test can implement the aforementioned Farnsworth-Munsell 100-Hue test.

At a block 403, a set of unordered color swatches is presented to the user. In some embodiments, the operating system presents the color swatches to the user via a display (e.g., see FIG. 7). These color swatches are of known color. Further, the color discrimination assessment test includes several sets of colors designed to test the entire color space of a user with normal color discrimination abilities. In some embodiments, the operating system includes a component such as color discrimination assessor 113 (FIG. 1) that is used perform these operations.

At a block 405, the user is requested to order the color swatches. In some embodiments, the operating system interacts with the user to instruct the user on how to order the color swatches and/or perform other operations needed to perform the color discrimination assessment. For example, the operating system may guide the user to order the presented color swatches so as to transition from one reference color to another reference color, and then submit the order to be analyzed by the operating system. In some embodiments, the operating system includes a component such as the aforementioned color discrimination assessor 113 (FIG. 1) that is used perform these operations.

At a decision block 407, the operating system determines whether another set of color swatches is to be presented to the user. In some embodiments, the operating system determines whether the user has attempted to order all of the sets of the color discrimination assessment test. In other embodiments, the operating system can adaptively determine whether another set of color swatches is to be presented to the user for ordering. For example, the sets may be organized in a tree-like structure, with sets to be presented to the user based on the results obtained from the user's ordering of the previous set, or from input from the user as to proceeding with more finely-tuned color discrimination testing. If another set of color swatches is to be presented to the user, the operational flow returns to block 403. If not, then the operational flow proceeds to a block 409. In some embodiments, the operating system includes a component such as the aforementioned color discrimination assessor 113 (FIG. 1) that is used perform these operations.

At block 409, gap(s) in the user's discriminable color space (if any) are identified. In some embodiments, the user's entire color space with respect to a color space of a person having normal color discrimination is tested, so that both gap(s) and discriminable portions of the user's discriminable color space are identified. In other embodiments, only the gap or gaps are identified. The operating system can also store the identified gap/gaps (or gap/gaps and discriminable portions) in a datastore (e.g., user color information datastore 117 of FIG. 1). In some embodiments, the operating system includes a component such as the aforementioned color discrimination assessor 113 (FIG. 1) that is used perform these operations.

Although the operational flow of block 303 is illustrated and described sequentially, in other embodiments, the operations described in the blocks may be performed in different orders, multiple times, and/or in parallel.

Figure 5:
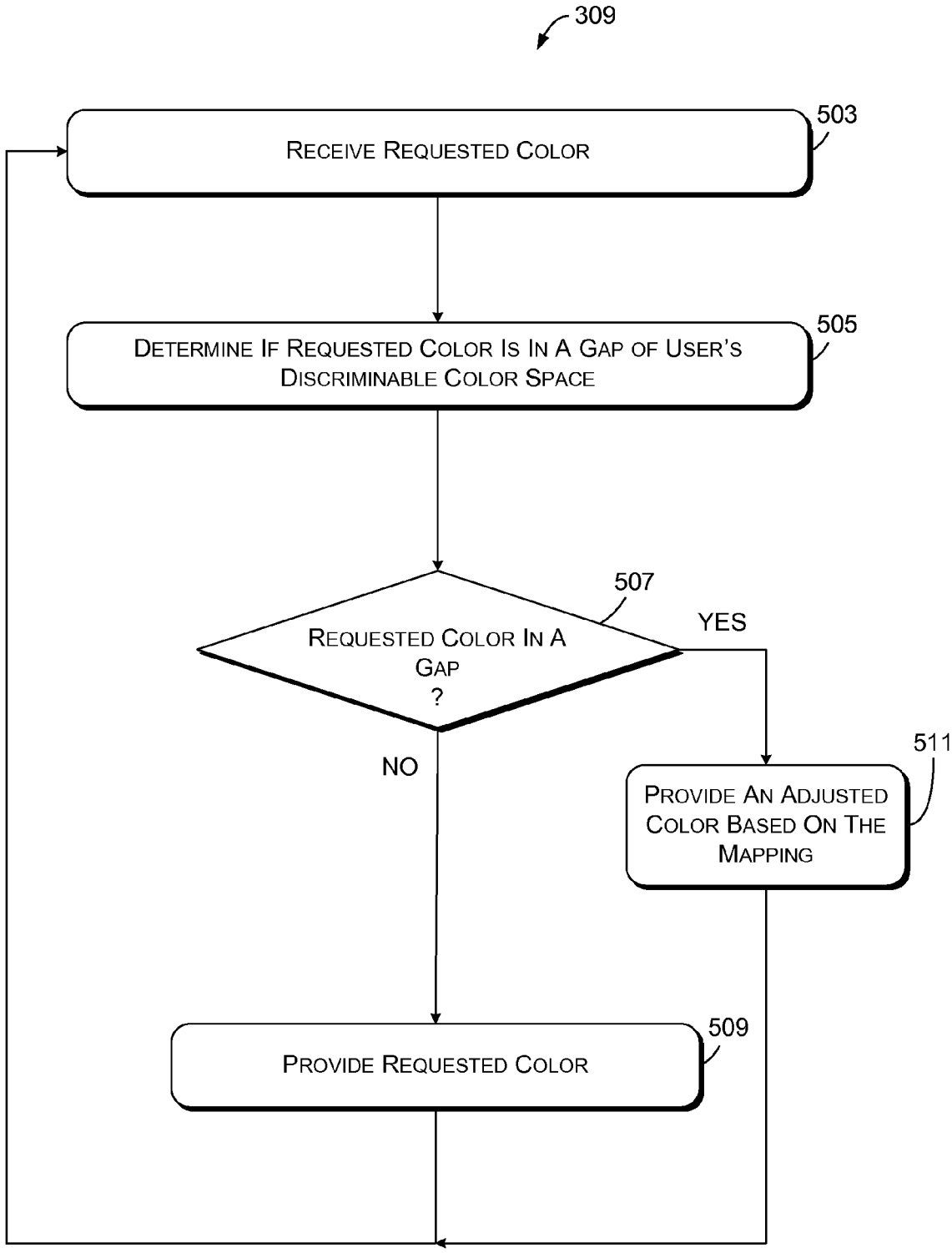
FIG. 5 is a flow diagram generally illustrating operational flow of the operating system of FIG. 3 in mapping a requested color to an adjusted, according to one embodiment.

FIG. 5 generally illustrates operational flow of an operating system in performing block 309 (FIG. 3), according to one embodiment. In some embodiments, block 309 includes using a mapping (e.g., from block 307) to provide an adjusted color in response to a requested color that is in a gap of the user's discriminable color space.

At a block 503, the operating system receives a request for color. In some embodiments, this request may be part of the normal operations performed by the operating system in displaying images on a display or monitor. For example, an application 105 (FIG. 1) may send this request to operating system 103 (FIG. 1).

At a block 505, the operating system compares the requested color to the gaps (if any) in the user's discriminable color space. In some embodiments, the operating system may include a component or components having functionality similar to previously described color assessor 113 (FIG. 1) to compare the requested color to gap(s) in the user's discriminable color space. For example, as previously mentioned for embodiments in which the user's discriminable color space is defined using N bits, gaps in the user's discriminable color space can be defined as ranges of N-bit values. The operating system can then compare the N-bit value of the requested color to the ranges of N-bit values corresponding to the gaps (if any) determined at block 409 (FIG. 4).

At a decision block 507 the operating system determines whether the requested color is in a gap in the user's discriminable color space based on the comparison of block 505. Continuing the example described in conjunction with block 505, in some embodiments the operating system determines whether the requested color is within the range of each gap (if any) in the user's discriminable color space. In some embodiments, the operating system includes a component such as the aforementioned color adjuster 115 (FIG. 1) that is used perform these operations.

If the requested color is not in a gap of the user's discriminable color space (i.e., the requested color is one that the user can discriminate), operational flow proceeds to a block 509 in which the operating system uses the requested color instead of an adjusted color. That is, in some embodiments, the requested color is handled by the operating system in a conventional manner. The operational flow can then return to block 503 to receive another color request.

Conversely, if the requested color is in a gap of the user's discriminable color space, operational flow proceeds to a block 511. At block 511, the operating system provides an adjusted color based on a mapping (e.g., as determined at block 307 of FIG. 3). As previously described, an adjusted color can include a color that the user can discriminate and/or cues such as flashing of the displayed color; cross-hatching of the displayed color, outlining of the region having a non-discriminable, etc. The operational flow can then return to block 503 to receive another color request. In some embodiments, the operating system includes a component such as the aforementioned color adjuster 115 (FIG. 1) that is used perform these operations.

Although the operational flow of block 309 is illustrated and described sequentially, in other embodiments, the operations described in the blocks may be performed in different orders, multiple times, and/or in parallel.

Illustrative Alternative Mapping Techniques

Figure 6:
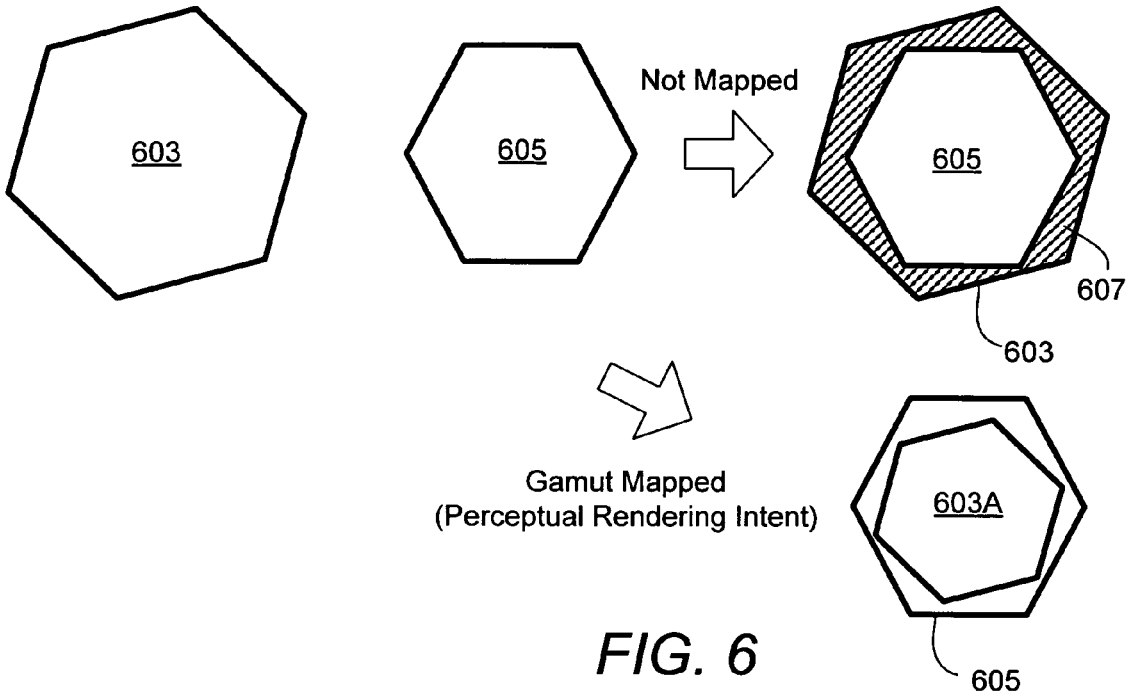
FIGS. 6 and 6A are diagrams generally illustrating device gamut mapping and an exemplary user's discriminable color space to a normal viewer's color space.
Figure 6A:
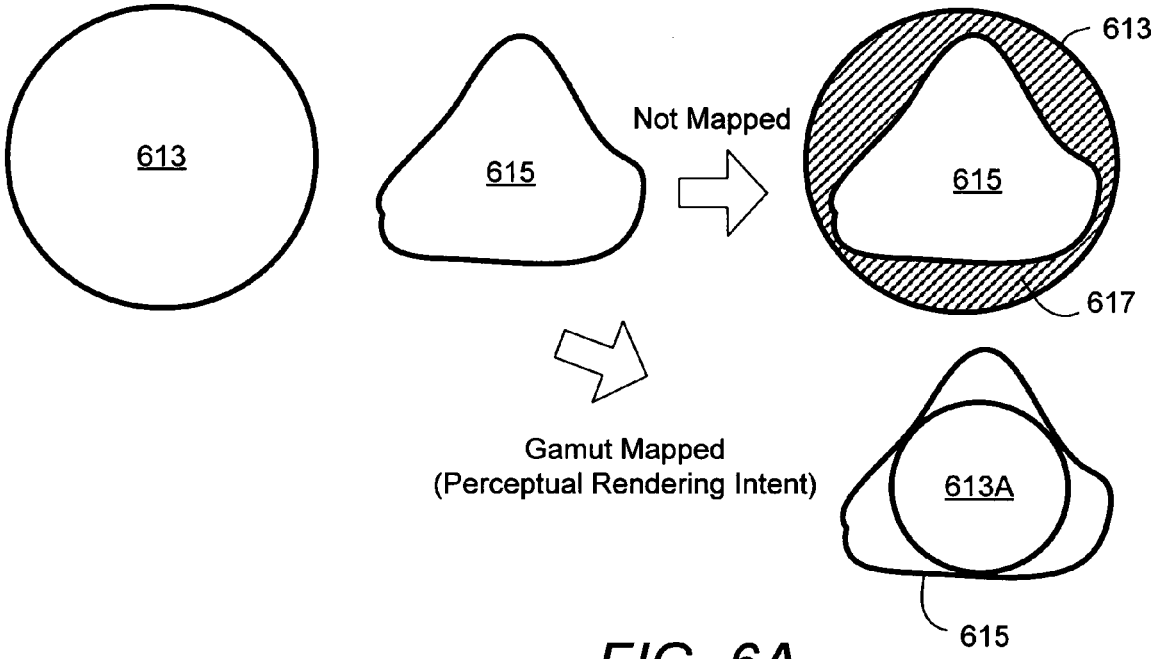

FIGS. 6 and 6A generally illustrate device gamut mapping techniques as applied to a user's discriminable color space, in accordance with one embodiment of the present invention. More particularly, FIG. 6 illustrates device gamut mapping and FIG. 6A illustrates gamut mapping of an exemplary user's discriminable color space to a normal viewer's color space. Device gamut mapping is described as background to facilitate understanding of gamut mapping of the user's discriminable color space to an output device.

FIG. 6 shows exemplary device gamuts 603 and 605. In this example, the input device is a camera (not shown) having representative device gamut 603 and the output device is a printer (not shown) having representative device gamut 605.

When device gamuts 603 and 605 are aligned without gamut mapping, there can be a portion or portions of the camera's gamut 603 that lie outside of printer's gamut 605. Such "outside" portions are referred to herein as truncated portions. In the example of FIG. 6, the truncated portion 607 is cross-hatched and represents colors that the camera may capture but cannot be accurately reproduced by the printer.

To address this problem, some systems use device gamut mapping techniques in printing photographs from images captured by the camera. In some device gamut mapping techniques, colors that can be captured by the camera but cannot be reproduced by the printer are mapped to the closest matching color. This device mapping technique is sometimes referred to as having an absolute colorometric rendering intent. In applications in which colors are defined using N-bit values, this gamut mapping technique can map multiple N-bit input values to one N-bit output value. Because more than one input color may be mapped to one output color, there is typically some loss of detail in the output image (sometimes referred to as gamut clipping).

Another device gamut mapping technique is illustrated in FIG. 6. In this alternative gamut mapping technique, the gamut of the input device (i.e., camera in this example) is transformed using a transform function to "distort" the input device's gamut so that relationships between similar colors are preserved to some extent. FIG. 6 shows how device gamut 603 of the camera is transformed into a gamut 603A so all of transformed gamut 603A is within device gamut 605 of the printer. Thus, there is no truncated portion as is the case when no gamut mapping is performed. Consequently, all of the colors that can be captured by the camera can be mapped to a unique color that can be printed by the printer. The compression of device gamut 603 into transformed gamut 603A does cause some distortion of the image colors relative to the actual colors captured by the camera, but this result can be more acceptable than gamut clipping in some applications.

This gamut mapping allows for some detail to be discernible in the "outside" colors (i.e., colors that cannot be reproduced by the printer, represented by truncated portion 607). However, the transformation causes input colors that could be reproduced by the printer to be distorted (i.e., the output colors do not accurately reflect the input colors even though the printer could have precisely reproduced them). This gamut mapping technique is sometimes referred to as having a perceptual rendering intent.

In a manner similar to mapping of device gamuts, the user's discriminable color space can be treated as a gamut. In accordance with some embodiments of the present invention, the user's discriminable color space is treated as the output gamut, and the color space of a person with normal color discrimination abilities is treated as the input gamut. An example to illustrate the concept is shown in FIG. 6A. The color space of a person with normal color discrimination ability is represented by a gamut 613. The color space of a user with a color discrimination disability is represented by a gamut 615. When aligned without gamut mapping, a truncated portion 617 results and represents colors that a person with normal color discrimination can discriminate but a person with a color discrimination disability cannot.

In accordance with an embodiment of the present invention, gamut 613 representing a "normal" color space is transformed/compressed into transformed gamut 613A, which fits entirely within "disabled" gamut 615, thereby eliminating truncated region 617. Various gamut mapping algorithms (GMAs) can be used, including linear, piece-wise linear, polynomial compression and other non-linear algorithms. For example, in some embodiments, the GMA can be the CUSP, SLIN or other GMA as disclosed by J. Morovic in "*To Develop a Universal Gamut Mapping Algorithm*", PhD. Thesis, University of Derby, Derby, UK (1998).

As can be seen in FIG. 6A, transforming/compressing the colors of a "normal" person's color space into the user's discriminable color space achieves the equivalent of gamut mapping with perceptional rendering intent. Thus, similar to the effect achieved by device gamut mapping with perceptual rendering intent, a user with a color discrimination disability can detect to some degree details in color regions of an image that the user could not normally discriminate at all.

Application to Other Sensory Features

The various embodiments described above are directed to color sensing by a user. However, a computer or like device can also provide other sensory stimulus (e.g., sound) to a user. In alternative embodiments, the techniques described above can also be applied to such other sensory stimulus outputted by a computer or like device. For example, a stimulus space can be defined for a user having normal discrimination for that stimulus. A user can then be assessed to determine if the user has a stimulus space that is different from that of a normal user. If a stimulus to be outputted by the computer or like device lies in a portion of a "normal" stimulus space that is not present in the user's stimulus space (i.e., a gap in the user's stimulus space), in a manner similar to the above described "visual" embodiments, the operating system of the computer or like device can be designed to map the stimulus to an adjusted stimulus that can be discriminated by the user.

Illustrative Operating Environment

The various embodiments described above may be implemented in computer environments. An example computer environment suitable for use in computer systems or like devices is described below in conjunction with FIG. 7.

Figure 7:
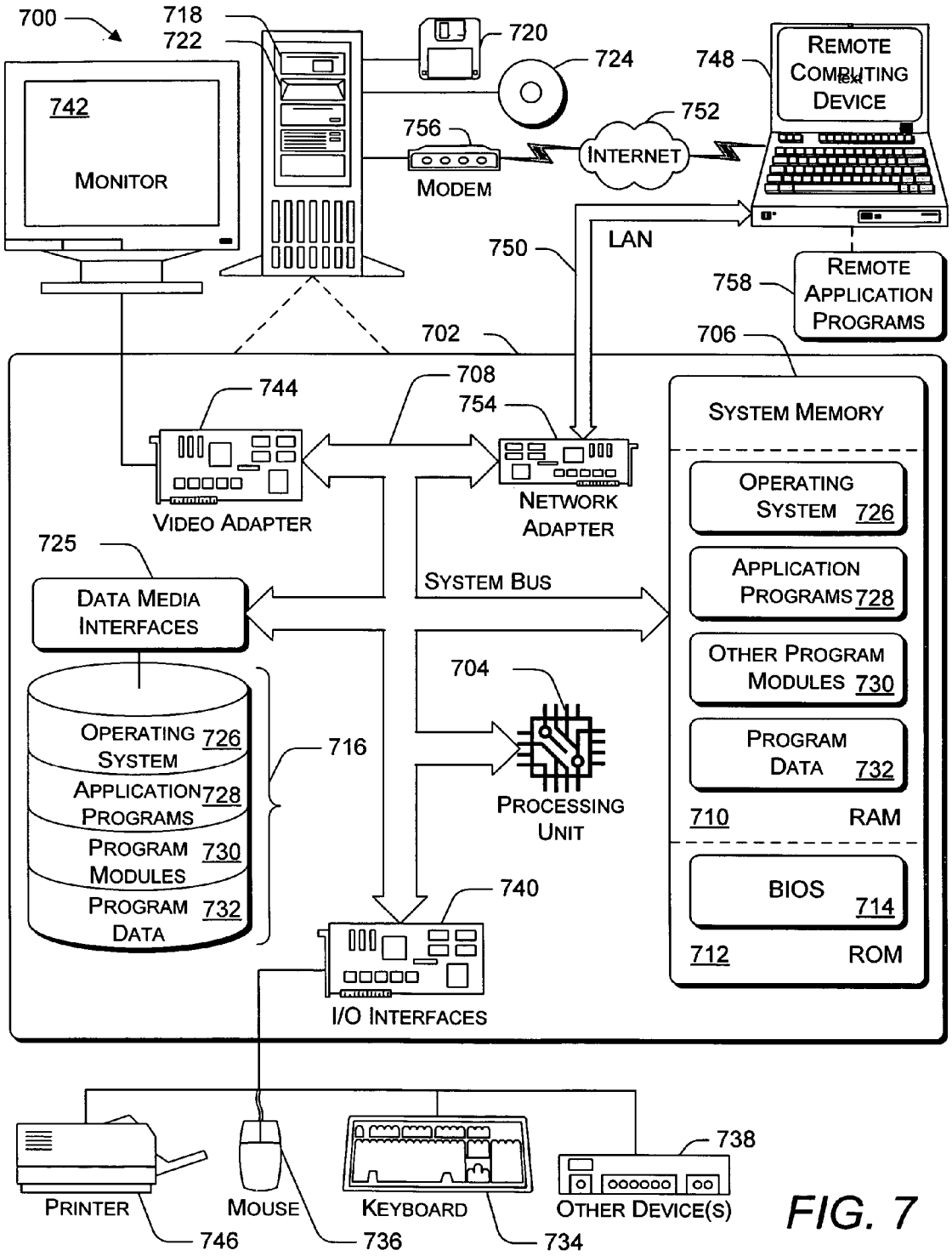
FIG. 7 is a functional block diagram generally showing an illustrative computing environment in which various embodiments of the techniques and mechanisms described herein may be implemented.

FIG. 7 illustrates a general computer environment 700, which can be used to implement the embodiments described herein. The computer environment 700 is only one example of a computing environment and is not intended to suggest any limitation as to the scope of use or functionality of the computer and network architectures. Neither should the computer environment 700 be interpreted as having any dependency or requirement relating to any one or combination of components illustrated in the example computer environment 700.

Computer environment 700 includes a general-purpose computing device in the form of a computer 702. The components of computer 702 can include, but are not limited to, one or more processors or processing units 704, system memory 706, and system bus 708 that couples various system components including processor 704 to system memory 706.

System bus 708 represents one or more of any of several types of bus structures, including a memory bus or memory controller, a peripheral bus, an accelerated graphics port, and a processor or local bus using any of a variety of bus architectures. By way of example, such architectures can include an Industry Standard Architecture (ISA) bus, a Micro Channel Architecture (MCA) bus, an Enhanced ISA (EISA) bus, a Video Electronics Standards Association (VESA) local bus, a Peripheral Component Interconnects (PCI) bus also known as a Mezzanine bus, a PCI Express bus, a Universal Serial Bus (USB), a Secure Digital (SD) bus, or an IEEE 1394, i.e., FireWire, bus.

Computer 702 may include a variety of computer readable media. Such media can be any available media that is accessible by computer 702 and includes both volatile and non-volatile media, removable and non-removable media.

System memory 706 includes computer readable media in the form of volatile memory, such as random access memory (RAM) 710; and/or non-volatile memory, such as read only memory (ROM) 712 or flash RAM. Basic input/output system (BIOS) 714, containing the basic routines that help to transfer information between elements within computer 702, such as during start-up, is stored in ROM 712 or flash RAM. RAM 710 typically contains data and/or program modules that are immediately accessible to and/or presently operated on by processing unit 704.

Computer 702 may also include other removable/non-removable, volatile/non-volatile computer storage media. By way of example, FIG. 7 illustrates hard disk drive 716 for reading from and writing to a non-removable, non-volatile magnetic media (not shown), magnetic disk drive 718 for reading from and writing to removable, non-volatile magnetic disk 720 (e.g., a "floppy disk"), and optical disk drive 722 for reading from and/or writing to a removable, non-volatile optical disk 724 such as a CD-ROM, DVD-ROM, or other optical media. Hard disk drive 716, magnetic disk drive 718, and optical disk drive 722 are each connected to system bus 708 by one or more data media interfaces 725. Alternatively, hard disk drive 716, magnetic disk drive 718, and optical disk drive 722 can be connected to the system bus 708 by one or more interfaces (not shown).

The disk drives and their associated computer-readable media provide non-volatile storage of computer readable instructions, data structures, program modules, and other data for computer 702. Although the example illustrates a hard disk 716, removable magnetic disk 720, and removable optical disk 724, it is appreciated that other types of computer readable media which can store data that is accessible by a computer, such as magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like, can also be utilized to implement the example computing system and environment.

Any number of program modules can be stored on hard disk 716, magnetic disk 720, optical disk 724, ROM 712, and/or RAM 710, including by way of example, operating system 726, one or more application programs 728, other program modules 730, and program data 732. Each of such operating system 726, one or more application programs 728, other program modules 730, and program data 732 (or some combination thereof) may implement all or part of the resident components that support the distributed file system.

A user can enter commands and information into computer 702 via input devices such as keyboard 734 and a pointing device 736 (e.g., a "mouse"). Other input devices 738 (not shown specifically) may include a microphone, joystick, game pad, satellite dish, serial port, scanner, and/or the like. These and other input devices are connected to processing unit 704 via input/output interfaces 740 that are coupled to system bus 708, but may be connected by other interface and bus structures, such as a parallel port, game port, or a universal serial bus (USB).

Monitor 742 or other type of display device can also be connected to the system bus 708 via an interface, such as video adapter 744. In addition to monitor 742, other output peripheral devices can include components such as speakers (not shown) and printer 746, which can be connected to computer 702 via I/O interfaces 740.

Computer 702 can operate in a networked environment using logical connections to one or more remote computers, such as remote computing device 748. By way of example, remote computing device 748 can be a PC, portable computer, a server, a router, a network computer, a peer device or other common network node, and the like. Remote computing device 748 is illustrated as a portable computer that can include many or all of the elements and features described herein relative to computer 702. Alternatively, computer 702 can operate in a non-networked environment as well.

Logical connections between computer 702 and remote computer 748 are depicted as a local area network (LAN) 750 and a general wide area network (WAN) 752. Such networking environments are commonplace in offices, enterprise-wide computer networks, intranets, and the Internet.

When implemented in a LAN networking environment, computer 702 is connected to local network 750 via network interface or adapter 754. When implemented in a WAN networking environment, computer 702 typically includes modem 756 or other means for establishing communications over wide network 752. Modem 756, which can be internal or external to computer 702, can be connected to system bus 708 via I/O interfaces 740 or other appropriate mechanisms. It is to be appreciated that the illustrated network connections are examples and that other means of establishing at least one communication link between computers 702 and 748 can be employed.

In a networked environment, such as that illustrated with computing environment 700, program modules depicted relative to computer 702, or portions thereof, may be stored in a remote memory storage device. By way of example, remote application programs 758 reside on a memory device of remote computer 748. For purposes of illustration, applications or programs and other executable program components such as the operating system are illustrated herein as discrete blocks, although it is recognized that such programs and components reside at various times in different storage components of computing device 702, and are executed by at least one data processor of the computer.

Various modules and techniques may be described herein in the general context of computer-executable instructions, such as program modules, executed by one or more computers or other devices. Generally, program modules include routines, programs, objects, components, data structures, etc. for performing particular tasks or implement particular abstract data types. Typically, the functionality of the program modules may be combined or distributed as desired in various embodiments.

An implementation of these modules and techniques may be stored on or transmitted across some form of computer readable media. Computer readable media can be any available media that can be accessed by a computer. By way of example, and not limitation, computer readable media may comprise "computer storage media" and "communications media."

"Computer storage media" includes volatile and non-volatile, removable and non-removable media implemented in any method or technology for storage of information such as computer readable instructions, data structures, program modules, or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

"Communication media" typically embodies computer readable instructions, data structures, program modules, or other data in a modulated data signal, such as carrier wave or other transport mechanism. Communication media also includes any information delivery media. The term "modulated data signal" means a signal that has one or more of its characteristics set or changed in such a manner as to encode information in the signal. As a non-limiting example only, communication media includes wired media such as a wired network or direct-wired connection, and wireless media such as acoustic, RF, infrared, and other wireless media. Combinations of any of the above are also included within the scope of computer readable media.

Reference has been made throughout this specification to "one embodiment," "an embodiment," or "an example embodiment" meaning that a particular described feature, structure, or characteristic is included in at least one embodiment of the present invention. Thus, usage of such phrases may refer to more than just one embodiment. Furthermore, the described features, structures, or characteristics may be combined in any suitable manner in one or more embodiments.

One skilled in the relevant art may recognize, however, that the invention may be practiced without one or more of the specific details, or with other methods, resources, materials, etc. In other instances, well known structures, resources, or operations have not been shown or described in detail merely to avoid obscuring aspects of the invention.

While example embodiments and applications have been illustrated and described, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the claimed invention.

Depending on the exact configuration and type of computing device, memory 704 may be volatile (such as RAM), non-volatile (such as ROM, flash memory, etc.) or some combination of the two. This most basic configuration is illustrated in FIG. 7 by dashed line 706. Additionally, computing device 700 may also have additional features/functionality. For example, computing device 700 may also include additional storage (removable and/or non-removable) including, but not limited to, magnetic or optical disks or tape. Such additional storage is illustrated in FIG. 7 by removable storage 708 and non-removable storage 710. Computer storage media includes volatile and nonvolatile, removable and non-removable media implemented in any method or technology for storage of information such as computer readable instructions, data structures, program modules or other data. Memory 704, removable storage 708 and non-removable storage 710 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can accessed by computing device 700. Any such computer storage media may be part of computing device 700.

Computing device 700 may also contain communications connection(s) 712 that allow the device to communicate with other devices. Communications connection(s) 712 is an example of communication media. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

Computing device 700 may also have input device(s) 714 such as keyboard, mouse, pen, voice input device, touch input device, etc. Output device(s) 716 such as a display, speakers, printer, etc. may also be included. All these devices are well know in the art and need not be discussed at length here.

Computing device 700 may include a variety of computer readable media. Computer readable media can be any available media that can be accessed by computing device 700 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by computing device 700. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

Various modules and techniques may be described herein in the general context of computer-executable instructions, such as program modules, executed by one or more computers or other devices. Generally, program modules include routines, programs, objects, components, data structures, etc. for performing particular tasks or implement particular abstract data types. These program modules and the like may be executed as native code or may be downloaded and executed, such as in a virtual machine or other just-in-time compilation execution environment. Typically, the functionality of the program modules may be combined or distributed as desired in various embodiments.

An implementation of these modules and techniques may be stored on or transmitted across some form of computer readable media. Computer readable media can be any available media that can be accessed by a computer. By way of example, and not limitation, computer readable media may comprise "computer storage media" and "communications media."

"Computer storage media" includes volatile and non-volatile, removable and non-removable media implemented in any method or technology for storage of information such as computer readable instructions, data structures, program modules, or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

"Communication media" typically embodies computer readable instructions, data structures, program modules, or other data in a modulated data signal, such as carrier wave or other transport mechanism. Communication media also includes any information delivery media. The term "modulated data signal" means a signal that has one or more of its characteristics set or changed in such a manner as to encode information in the signal. As a non-limiting example only, communication media includes wired media such as a wired network or direct-wired connection, and wireless media such as acoustic, RF, infrared, and other wireless media. Combinations of any of the above are also included within the scope of computer readable media.

Reference has been made throughout this specification to "one embodiment," "an embodiment," or "an example embodiment" meaning that a particular described feature, structure, or characteristic is included in at least one embodiment of the present invention. Thus, usage of such phrases may refer to more than just one embodiment. Furthermore, the described features, structures, or characteristics may be combined in any suitable manner in one or more embodiments.

One skilled in the relevant art may recognize, however, that the invention may be practiced without one or more of the specific details, or with other methods, resources, materials, etc. In other instances, well known structures, resources, or operations have not been shown or described in detail merely to avoid obscuring aspects of the invention.

While example embodiments and applications have been illustrated and described, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the claimed invention.

What is claimed is:

1. A method for displaying an image to a user of a computing device having a display, the user having a color discrimination disability, the method comprising:

obtaining information regarding a color that the user cannot discriminate, wherein the obtaining is performed by an operating system of the computing device;

mapping the color to an adjusted color, wherein the mapping is performed by the operating system; and providing the adjusted color in response to a request for the color, wherein the providing is performed by the operating system, wherein mapping comprises performing a gamut mapping algorithm of a reference color space to the user's discriminable color space, wherein the gamut mapping algorithm compresses the reference color space to a compressed color space, and wherein the compressed color space is contained within the user's discriminable color space.

2. The method of claim 1, further comprising storing the mapping in a data structure.

3. The method of claim 1, wherein the adjusted color is a color discriminable by the user.

4. The method of claim 1, wherein the adjusted color comprises a cue.

5. The method of claim 4, wherein the cue comprises causing the color to flash.

6. The method of claim 4, wherein the cue comprises a label to identify the color.

7. The method of claim 4, wherein the cue comprises outlining a region of an image that consists of the color.

8. The method of claim 1, wherein obtaining information comprises interacting with the user to perform a color discrimination assessment.

9. The method of claim 1, wherein obtaining information comprises obtaining data from a previously performed color discrimination assessment.

10. The method of claim 9, wherein the data from a previously performed color discrimination assessment is obtained from a source external to the computing device.

11. The method of claim 1, wherein obtaining information comprises requesting the user to identify any condition the user has that affects the user's color discrimination ability.

12. A computer-readable medium encoded with a computer program having instructions for performing the method of claim 1.

13. An apparatus for displaying an image to a user of a computing device having a display, the user having a color discrimination disability, the apparatus comprising:

a processor; and an operating system to be executed by the processor, the operating system comprising:

means for obtaining information regarding a color that the user cannot discriminate;

means for mapping the color to an adjusted color; and means for providing, the adjusted color in response to a request for the color, wherein the mapping means comprises means for performing a gamut mapping algorithm of a reference color space to the user's discriminable color space, wherein the gamut mapping algorithm compresses the reference color space to a compressed color space, wherein the compressed color space is contained within the user's discriminable color space, and wherein the gamut mapping algorithm is a linear, piecewise linear, polynomial, or non-linear algorithm.

14. The apparatus of claim 13, further comprising means for storing the mapping in a data structure.

15. The apparatus of claim 13, wherein the adjusted color is a color discriminable by the user.

16. The apparatus of claim 13, wherein the means for obtaining information comprises means for performing a color discrimination assessment.

17. The apparatus of claim 16, wherein the color discrimination assessment is adaptive.

18. The apparatus of claim 13, wherein the means for obtaining information comprises means for obtaining data from a previously performed color discrimination assessment.

19. The apparatus of claim 18, wherein the data from a previously performed color discrimination assessment is obtained from a source external to the computing device.

20. The apparatus of claim 13, wherein the means for obtaining information comprises means for requesting the user to identify any condition the user has that affects the user's color discrimination ability.

21. A machine readable medium encoded with a computer program having components to implement the operating system recited in claim 13.

22. A computer readable medium encoded with an operating system, application program interface and a computer program to be executed on a computing device, comprising:

a color discrimination assessor to obtain information regarding a user's discriminable color space; and a color adjuster to provide an adjusted color in response to a requested color that is in a gap of the user's discriminable color space, wherein the color adjuster is to perform a gamut mapping algorithm of a reference color space to the user's discriminable color space, wherein the gamut mapping algorithm compresses the reference color space to a compressed color space, wherein the compressed color space is contained within the user's discriminable color space, and wherein the gamut mapping algorithm is a linear, piecewise linear, polynomial, or non-linear algorithm.

23. The computer readable medium of claim 22, wherein the requested color is requested by an application.

24. The computer readable medium of claim 22, wherein the adjusted color is a color discriminable by the user.

25. The computer readable medium of claim 22, wherein the adjusted color comprises a cue.

26. The computer readable medium of claim 22, wherein the color discrimination assessor is to interact with the user to perform a color discrimination assessment.

27. The computer readable medium of claim 26, wherein the color discrimination assessment is adaptive.

28. The computer readable medium of claim 22, wherein the color discrimination assessor is to obtain data from a previously performed color discrimination assessment.

29. The computer readable medium of claim 28, wherein the color discrimination assessor is to obtain data of a previously performed color discrimination assessment test from a source external to the computing device.

30. The computer readable medium of claim 22, wherein the color discrimination assessor is to request that the user to identify any condition the user has that affects the user's color discrimination ability.

31. A machine readable medium encoded with a computer program having components to implement the operating system recited in claim 22.

32. The method of claim 8 wherein the color discrimination assessment is adaptive.

33. A method for outputting a type of stimuli to a user of a computing device, the user having a discrimination disability with regard to the type of stimuli, the method comprising:

obtaining information regarding a stimulus of the type of stimuli that the user cannot discriminate, wherein the obtaining is performed by an operating system of the computing device;

mapping the stimulus to an user's detectable stimulus space, wherein the mapping is performed by the operating system; and providing the adjusted stimulus in response to a request for the stimulus, wherein the providing is performed by the operating system wherein mapping comprises performing a mapping algorithm of a reference, stimulus space to the user's detectable stimulus space, wherein the gamut mapping algorithm compresses the reference stimulus space to a compressed stimulus space, wherein the compressed stimulus space is contained within the user's detectable stimulus space, and wherein the gamut mapping algorithm is a linear, piecewise linear, polynomial, or non-linear algorithm.

34. The method of claim 33, further comprising storing the mapping in a data structure.

35. The method of claim 33, wherein obtaining information comprises interacting with the user to perform a discrimination assessment for the type of stimuli.

36. The method of claim 33, wherein obtaining information comprises obtaining data from a previously performed discrimination assessment.

37. The method of claim 36, wherein the data from a previously performed discrimination assessment is obtained from a source external to the computing device.

38. A method for displaying an image to a user of a computing device having a display, the user having a color discrimination disability, the method comprising:

obtaining information regarding a color that the user cannot discriminate, wherein the obtaining is performed by an operating system of the computing device;

mapping the color to an adjusted color, wherein the mapping is performed by the operating system; and providing the adjusted color in response to a request for the color, wherein the providing is performed by the operating system, wherein obtaining information comprises interacting with the user to perform a color discrimination assessment, wherein the color discrimination assessment is an adaptive assessment, wherein the adaptive assessment provides a color assessment and based on the results of the results of the color assessment, the adaptive assessment provides a more finely tuned assessment, wherein mapping comprises performing a gamut mapping algorithm of a reference color space to the user's discriminable color space, wherein the gamut mapping algorithm compresses the reference color space to a compressed color space, and wherein the compressed color space is contained within the user's discriminable color space.

39. The method of claim 38, wherein the gamut mapping algorithm is a linear, piece-wise linear, polynomial, or non-linear algorithm.

* * * * *